US007192310B1

(12) United States Patent
Chao et al.

(10) Patent No.: US 7,192,310 B1
(45) Date of Patent: Mar. 20, 2007

(54) HDMI CONNECTOR

(75) Inventors: Hsin-Min Chao, Tu-Cheng (TW); Kuo-Chin Lin, Tu-Cheng (TW); Shih-An Lee, Tu-Cheng (TW); Chin-Lan Fu, Tu-Cheng (TW); Te-Hua Hsu, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/434,236

(22) Filed: May 16, 2006

(51) Int. Cl.
*H01R 9/03* (2006.01)

(52) U.S. Cl. ..... 439/607

(58) Field of Classification Search ..... 439/607
See application file for complete search history.

(56) References Cited

U.S. PATENT DOCUMENTS 6,932,640 B1 * 8/2005 Sung ..... 439/405
6,997,733 B2 * 2/2006 Peng ..... 439/353
2005/0255752 A1 * 11/2005 Huang ..... 439/607

* cited by examiner

*Primary Examiner*—Briggitte R. Hammond
(74) *Attorney, Agent, or Firm*—Birch, Stewart, Kolasch and Birch, LLP

(57) ABSTRACT

A HDMI connector includes a dielectric housing, a plurality of terminals, a support board, an upper lid, a lower lid and wires. The dielectric housing has a plurality of terminal grooves extending from a front sidewall to a rear sidewall. The terminals are inserted into the terminal grooves. The support board connects with the rear sidewall of the dielectric housing. A plurality of channels are disposed on a top surface and a bottom surface thereon. The upper lid has a plurality of first clip grooves disposed on the lower surface, and a plurality of protrusions are formed therebetween. The lower lid has a plurality of second clip grooves disposed on the upper surface, and a plurality of protrusions are formed therebetween. The wires are arranged in the channels connecting with the terminals. The upper lid and the lower lid buckle with the channels to fix the wires in the channels.

5 Claims, 7 Drawing Sheets

HDMI CONNECTOR

BACKGROUND OF THE INVENTION

1. Field of the Invention

The present invention relates to a HDMI (High Definition Multimedia Interface) connector, and more particularly, to the HDMI connector having a plurality of wires respectively soldering with the terminals accurately and firmly.

2. The Related Art

HDMI (High Definition Multimedia Interface) is a transmission interface developed for the next generation multimedia audio video systems including the DVD players, game box converter, TV box, and etc. Because HDMI is practical for transmitting digital data without compression, it effectively reduces signal interference and attenuation due to conversion between digital signal and analog signal.

FIG. 7 shows a conventional HDMI connector 200 which includes a dielectric housing 11 and a cable 12 having a plurality of wires 14. A plurality of terminals 13 are received in the dielectric housing 11. One end of each terminal 13 is extended from the rear sidewall of the dielectric housing 11.

When assembling the HDMI connector 200, the wires 14 of the cable 12 is soldered with the terminals 13. Each of the wires 14 is overlapped in such HDMI connector 200, so it is difficult to solder the wires 14 to the terminals 13 in a certain order accurately and firmly.

Improper soldering will affect the quality of the HDMI connector 200. Therefore, it is important to make a HDMI connector which ensuring the wires 14 soldering with the terminals 13 accurately and firmly.

SUMMARY OF THE INVENTION

It is an object of the present invention to provide a HDMI connector which includes a dielectric housing, a plurality of terminals, a support board, an upper lid, a lower lid and a plurality of wires. The dielectric housing has a plurality of terminal grooves at two rows extending from a front sidewall to a rear sidewall. The terminals are inserted into the terminal grooves respectively. The support board connects with the rear sidewall of the dielectric housing. A plurality of channels are disposed on top and bottom surfaces thereon. The upper lid has a plurality of first clip grooves disposed on the lower surface of the upper lid, and a plurality of protrusions are formed therebetween. The lower lid has a plurality of second clip grooves disposed on the upper surface of the lower lid, and a plurality of protrusions are formed therebetween. The wires are arranged in the channels connecting with the terminals. The upper lid and the lower lid buckle with the channels to fix the wires in the channels.

It can be seen that each wire is fixed in the corresponding channel. Therefore, it is convenient that the wires could be soldered to the terminals accurately and firmly. In this case, it effectively reduces signal interference and attenuation.

Other objects, novel features and advantages of the present invention will become more apparent from the following detailed description of a preferred embodiment thereof when taken in conjunction with the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

In order to illustrate the present invention particularly, including technology, structure traits, aims and efficiency, a detailed explanation of a preferred embodiment of the present invention will be given thereinafter, with reference to the annexed drawings, for better understanding thereof to those skilled in the art.

Figure 1:
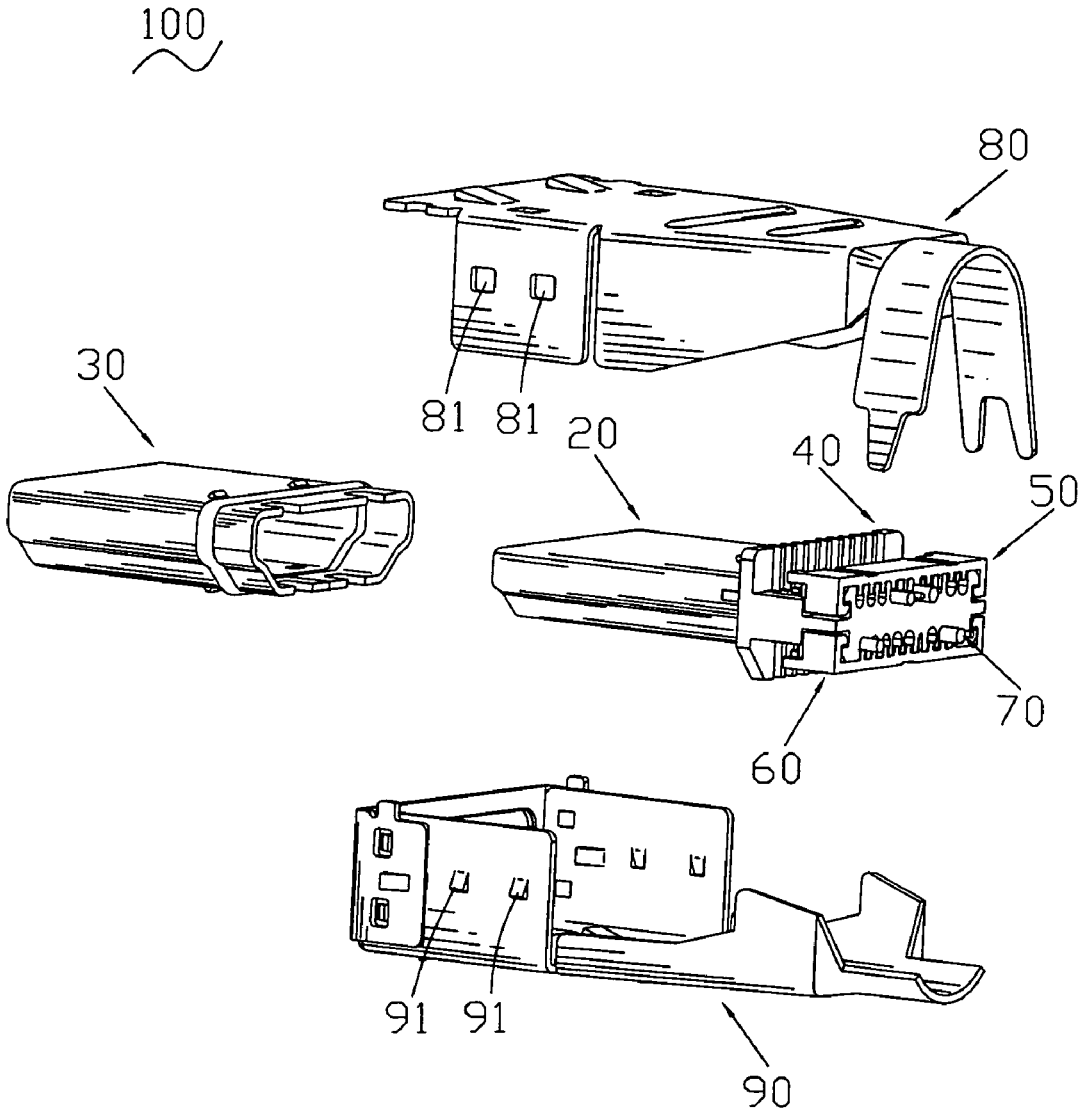
FIG. 1 is a perspective view of a HDMI connector with the present invention.

FIG. 1 illustrates a HDMI connector 100 of this invention. The HDMI connector 100 includes a dielectric housing 20, a cover 30 enclosing the dielectric housing 20, a support board 40 connecting with a rear end of the dielectric housing 20 and receiving a plurality of wires 70.

Figure 2:
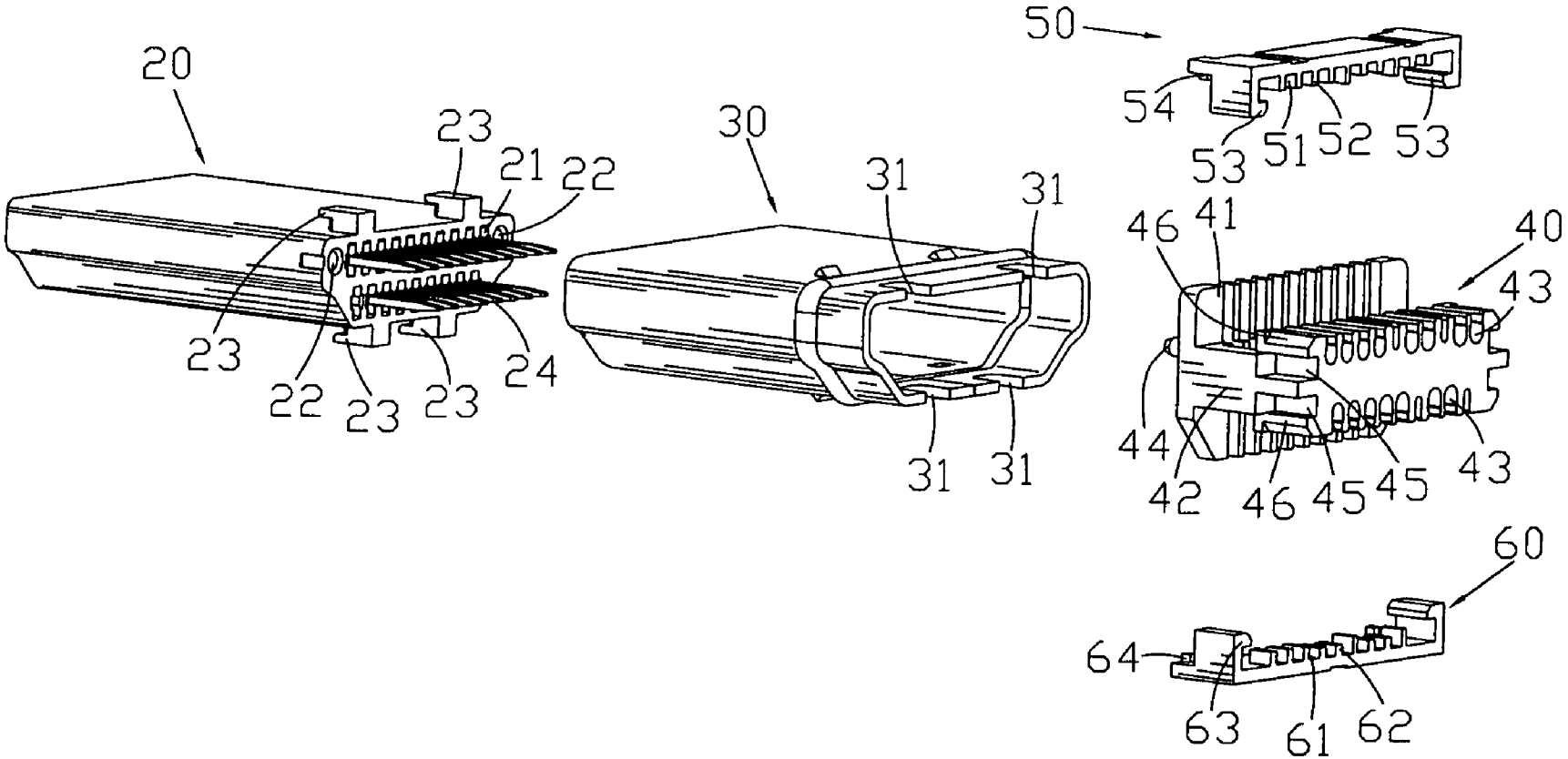
FIG. 2 is an exploded perspective view of the HDMI connector shown in FIG. 1.
Figure 3:
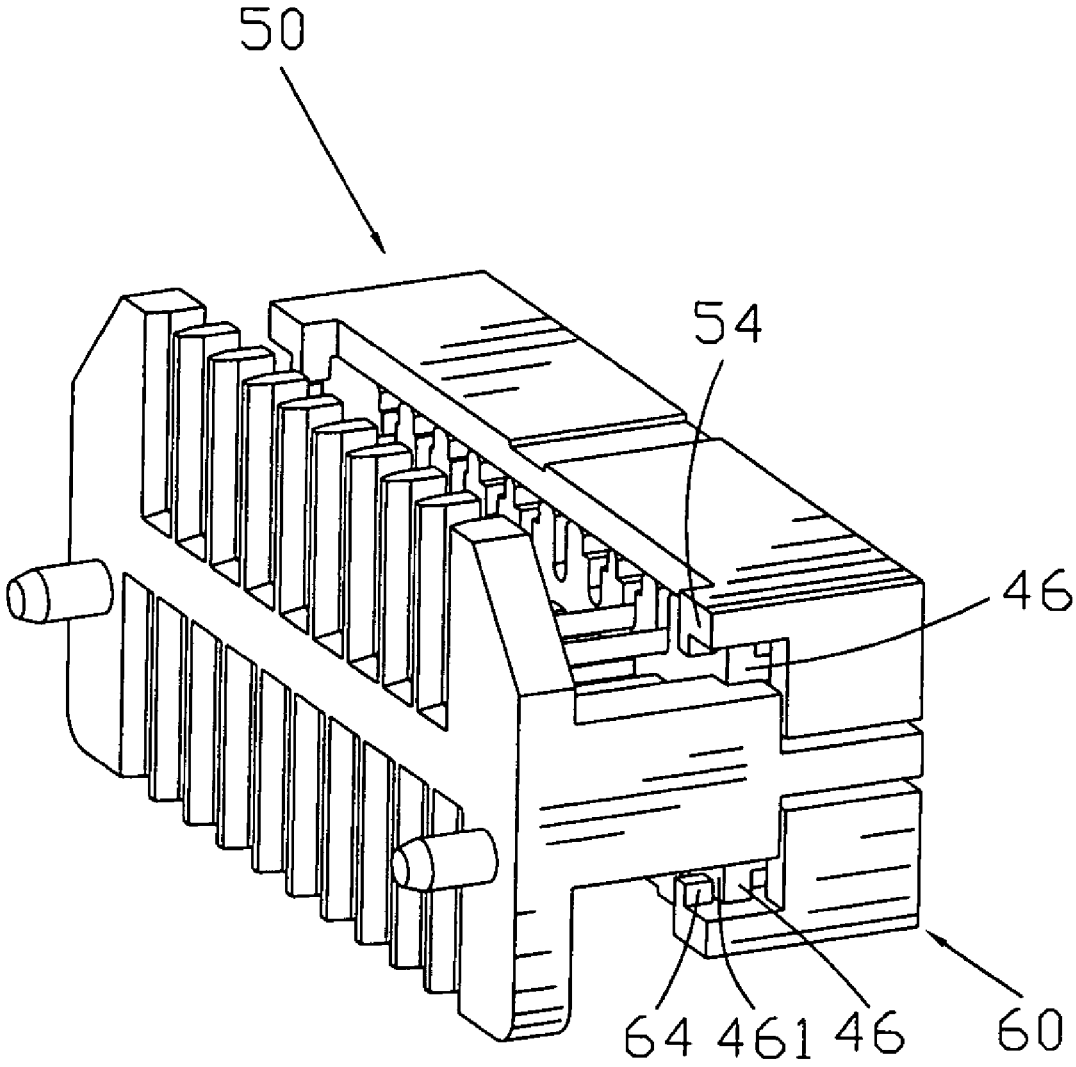
FIG. 3 is a perspective view after the support board, the upper lid and the lower lid are assembled.

Please referring to FIG. 2 and FIG. 3, the dielectric housing 20 has a plurality of terminal grooves 21 extending from a front sidewall to a rear sidewall. A plurality of terminals 24 are inserted into the terminal grooves 21. The tail of each terminal 24 are defined on the rear sidewall of the dielectric housing 20. Two mating holes 22 are defined on the rear sidewall of the dielectric housing 20 and located at the laterals of the top row terminal grooves 21. A pair of raised fasteners 23 is disposed on the top and bottom surfaces of the dielectric housing 20.

The cover 30 has the same shape with the outside shape of the dielectric housing 20. Two guidance notches 31 are defined on the top and bottom surfaces fastened with the raised fasteners 23 respectively.

The support board 40 has a vertical partition 41 and a positioning lump 42 extending backwardly from the middle of the vertical partition 41. A plurality of channels 43 are disposed on a top surface and a bottom surface thereon respectively. The channels 43 extend from the rear end to the front end of the positioning lump 42 and stretches out of the vertical partition 41 communicating with the outside. A pair of fixing pillars 44 corresponding to the two mating hole 22 respectively is protruded forwardly. Two fillisters 45 is disposed at opposite lateral side of the positioning lump 42. The lateral and rear side of the fillisters 45 are exposed and capable of clipping the buckling boards 53, 63 of upper and lower lids. A wedge 46 is located adjacent to the fillisters 45. The wedge 46 has a front surface 461.

The upper lid 50 has a plurality of first clip grooves 51 disposed on a lower surface of the lower lid 60, and a plurality of protrusions 52 are formed therebetween. Buckling boards 53 are disposed at opposite side of the upper lid 50 and the lower lid 60 respectively.

The lower lid 60 has a plurality of second clip grooves 61 disposed on an upper surface of the lower lid 60, and a plurality of protrusions 62 are formed therebetween. A pair of buckling boards 63 is disposed at the lateral of the lower lid 60 and extends downwardly. A pair of rectangle board 64 is located at the front of the lower lid 60. The upper lid 50 and the lower lid 60 have rectangle boards proximate to the bulking boards respectively, in which the rectangle boards 54 are set against the front surface.

Please further refer to FIG. 1. The HDMI connector 100 further includes an upper shield 80 having a pair of an opening 81 at the lateral thereof and a lower shield 90 having a projecting board 91. The projecting board 91 engages the opening 81 to secure the dielectric housing 20, the support board 40, the upper lid 50 and the lower lid 60 as a whole set.

When assembling the HDMI connector 100, firstly, the plurality of wires 70 are arranged in the channels 43 of the positioning lump 42. With reference to FIG. 3, a force is exerted on the upper lid 50 and the lower lid 60 so that the buckling boards 53, 63 engage with the wedge 46 respectively. The buckling boards 53, 63 are received in the fillisters 45, so the buckling boards 53, 63 are capable of clipping onto the fillisters 45. The rectangle board 64 abuts against the front surface 461 of the wedge 46.

Figure 4:
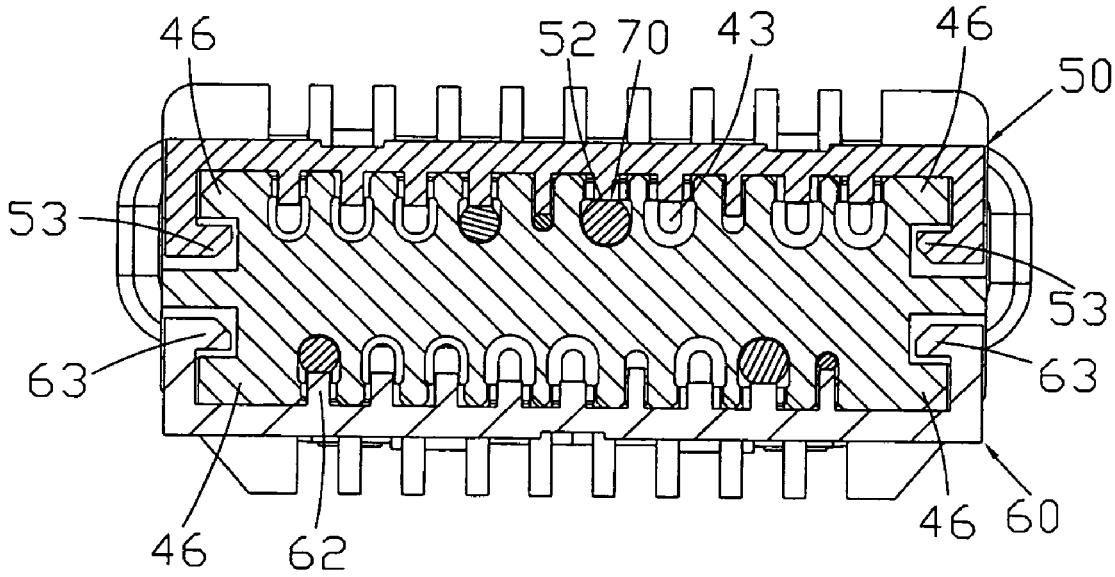
FIG. 4 is a cross-section view of the HDMI connector.

Please refer to FIG. 4. The upper lid 50 and the lower lid 60 buckle with the channels 43 through the protrusion 52 and the protrusion 62 to fix the wires channels 43.

Figure 5:
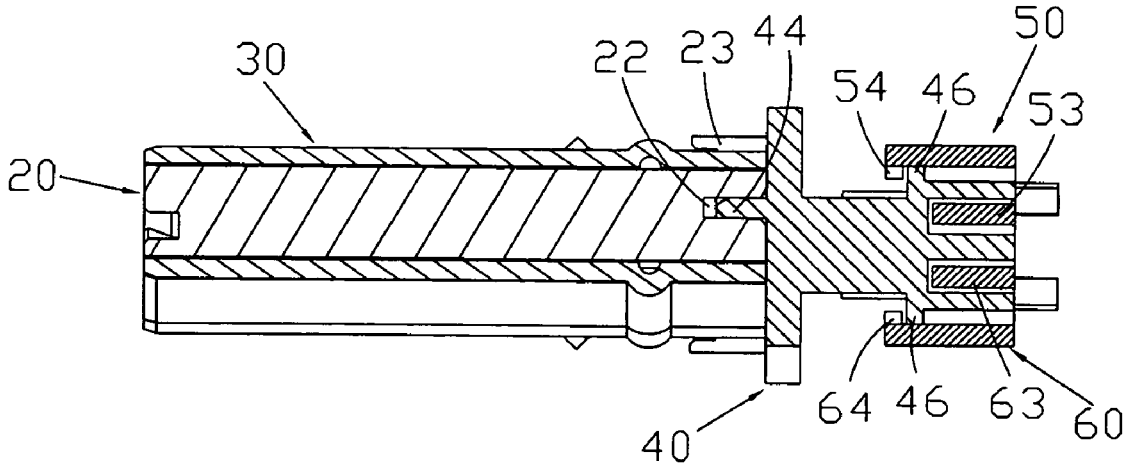
FIG. 5 is a cross-section view after the dielectric housing, the cover, the support board, the upper lid and the lower lid are assembled.

Please refer to FIG. 2 and FIG. 5. The raised fasteners 23 slide into the guidance notches 31 so that the cover 30 encloses the dielectric housing 20. The wires 70 are soldered with the tail of the terminal 24. The fixing pillars 44 is inserted into the mating hole 22 so that the support board 40 connects with the dielectric housing 20.

Figure 6:
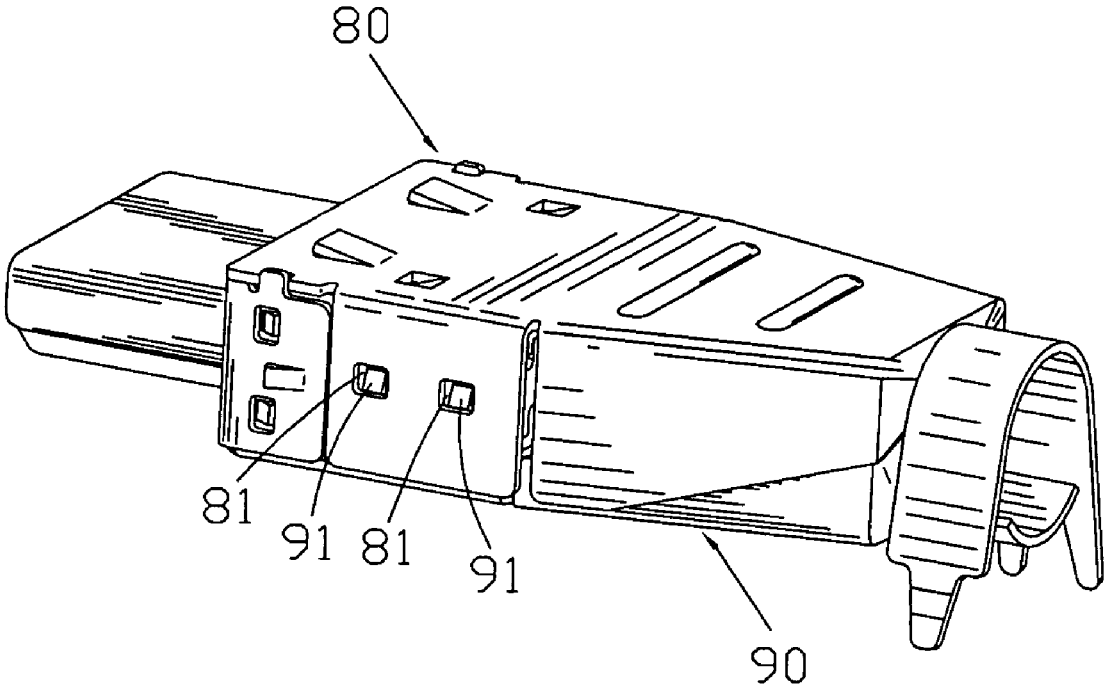
FIG. 6 is a perspective view of the HDMI connector.
Figure 7:
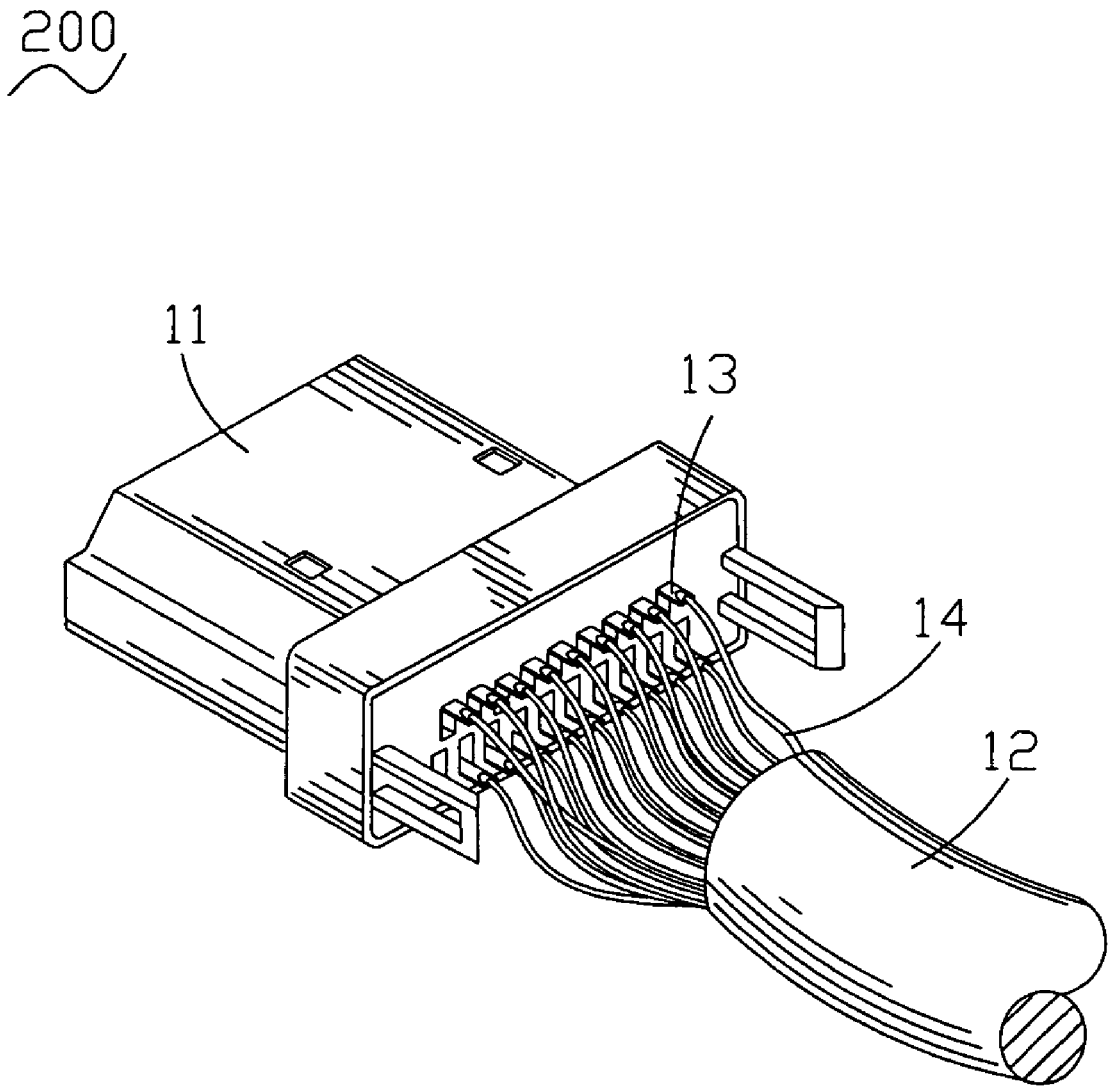
FIG. 7 (Prior Art)
FIG. 7 is a perspective view of a conventional HDMI connector.

At last, referring to FIG. 6, the upper shield 80 and the lower shield 90 cover the rear part of the dielectric housing 20. The projecting boards 91 engage with the openings 81 respectively.

It can be seen that the wires 70 could be respectively soldered with the terminals 24 accurately and firmly. Therefore, it effectively reduces signal interference and attenuation.

Although a preferred embodiment of the present invention has been described in detail hereinabove, it should be clearly understood that many variations and/or modifications of the basic inventive concepts herein taught which may appear to those skilled in the present art will fall within the spirit and scope of the present invention, as defined in the appended claims.

What is claimed is:

1. A connector for High Definition Multimedia Interface, comprising:

a dielectric housing having a plurality of terminal grooves extending from a front sidewall to a rear sidewall of the dielectric housing;

a plurality of terminals inserted into the terminal grooves;

a support board connecting with the rear sidewall of the dielectric housing, having a plurality of channels disposed on a top surface and a bottom surface of the support board, the support board having a vertical partition and a positioning lump;

an upper lid having a plurality of first clip grooves disposed on a lower surface of the upper lid, and a plurality of protrusions formed therebetween;

a lower lid having a plurality of second clip grooves disposed on an upper surface of the lower lid, and a plurality of protrusions formed therebetween;

a plurality of wires arranged in the channels for connecting with the terminal;

wherein the upper lid and the lower lid buckle the channels to secure the wires; and at least two fillisters disposed at opposite lateral sides of the positioning lump, and at least two wedge located adjacent to the fillisters, and at least two buckling boards disposed at opposite sides of the upper lid, wherein the buckling boards are capable of clipping onto the fillisters.

2. The connector as claimed in claim 1, further comprising a cover for enclosing the dielectric housing.

3. The connector as claimed in claim 1, further comprising an upper shield having an opening, and a lower shield having a projecting board, wherein the projecting board engages the opening to secure the dielectric housing, the support board, the upper lid and the lower lid as a whole set.

4. The connector as claimed in claim 1, wherein the wedge has a front surface, and the upper lid have rectangle boards proximate to the buckling boards, in which the rectangle boards are set against the front surface.

5. The connector as claimed in claim 1, wherein at least one mating hole is defined on the rear sidewall of the dielectric housing, and at least one of the fillisters corresponding to the mating hole is disposed at a rear lateral side of the positioning lump.

* * * * *